US006558093B1

(12) United States Patent
Arnold et al.

(10) Patent No.: US 6,558,093 B1
(45) Date of Patent: May 6, 2003

(54) AUTOMOBILE TRANSPORT SKID

(75) Inventors: Craig Arnold, Parkersburg, WV (US); Larry G. Gross, Marietta, OH (US); Amos Totten, Washington, WV (US)

(73) Assignee: Gatewood Products, LLC, Parkersburg, WV (US)

( * ) Notice: Subject to any disclaimer, the term of this patent is extended or adjusted under 35 U.S.C. 154(b) by 0 days.

(21) Appl. No.: 09/633,125

(22) Filed: Aug. 4, 2000

Related U.S. Application Data

(60) Provisional application No. 60/210,597, filed on Jun. 9, 2000.

(51) Int. Cl.[7] ..... B60P 7/00

(52) U.S. Cl. ..... 410/30; 410/3; 410/4; 410/52; 410/66; 410/67; 410/46; 108/55.3

(58) Field of Search ..... 410/2, 3, 4, 7, 410/30, 52, 66, 67, 46; 108/55.1, 55.3; 224/537, 571, 924

(56) References Cited

U.S. PATENT DOCUMENTS 2,557,105 A * 6/1951 Hight ..... 410/7 X
2,828,931 A * 4/1958 Harvey ..... 410/46
3,110,466 A * 11/1963 O'Sullivan ..... 410/30
3,912,139 A * 10/1975 Bowman ..... 410/3
4,068,813 A * 1/1978 Chatwin et al. ..... 410/7
4,307,985 A * 12/1981 Desprez et al. ..... 410/46
4,792,268 A * 12/1988 Smith ..... 410/9
4,929,133 A * 5/1990 Wiseman ..... 410/52
4,942,828 A * 7/1990 Walz et al. ..... 410/7 X
5,489,171 A * 2/1996 Claps et al. ..... 410/26
5,746,554 A * 5/1998 Boydtson, IV et al. ..... 410/12
6,006,676 A 12/1999 Creek et al.

* cited by examiner

*Primary Examiner*—Stephen T. Gordon
(74) *Attorney, Agent, or Firm*—Steptoe & Johnson PLLC

(57) ABSTRACT

An end cap attached to an end of skid for rolling a vehicle through the end cap and on to or off of the skid, the end cap having at least one channel extending through the end cap wherein each channel of the end cap is aligned with one channel in the top of the platform of the skid for holding the wheels of the vehicle. The end cap is attached to the top of a platform of a skid. In addition, the end cap can be designed and manufactured in either multiple segments or as a single component. The end cap may optionally have a vertical extension extending down from one side of the end cap and attaching to the bottom of the platform, thereby covering an end of the skid.

12 Claims, 7 Drawing Sheets

AUTOMOBILE TRANSPORT SKID

CROSS REFERENCE TO RELATED APPLICATIONS

This application claims the benefit of Application No. 60/210,597, filed in the U.S.P.T.O. on Jun. 9, 2000.

BACKGROUND OF THE INVENTION

1. Field of the Invention

The present invention relates to pallets and skids for transporting and storing vehicles, and more particularly, to the end caps of skids used in the transport and storage of two wheeled vehicles, e.g., motorcycles.

2. Related Art

Skids have been used to store and transport two wheeled vehicles, e.g., motorcycles, for over twenty years. Until recently, these prior art skids were made of wood and comprised a wooden platform having either one longitudinally centered single channel extending the entire length of the skid, or alternatively, two longitudinally centered channels spaced a predefined distance from each other. In operation, the two wheels of a motorcycle are positioned within the central channel(s) of a skid and the motorcycle is tied down, thereby securing the motorcycle to the skid. New skids are basically the same design and structure as the prior art skids, however, new skids are made of metal.

Regardless of the material used in constructing a skid, conventional skids have a bar at each end extending across the width of the skid and the channel(s) to prevent the vehicle from rolling off of the skid. For example, in U.S. Pat. No. 6,006,676 to Creek, et al., a metal skid is disclosed for shipping motorcycles having a cross member secured across each end of the skid wherein the cross members block the wheels of the motorcycle and prevent the motorcycle from rolling off of the end of the skid.

The disadvantage of these conventional skids is that to remove a two-wheeled vehicle, e.g., a motorcycle, from the skid, the vehicle has to be lifted, pushed or run over a cross member located at an end of the skid. As a result, an operator may easily strain his/her back or cause other injury in attempting to remove the vehicle from the skid. Alternatively, the operator may remove a cross member at one end of a skid to allow the motorcycle to be pushed or rolled through the central channel and off of the skid. In either method, the operator must take the time and exert extra effort in removing the motorcycle from the skid.

Therefore, there is a need for an end cap of a skid wherein a vehicle may easily be rolled on to and off of a skid while eliminating the need for lifting, pushing or raising the vehicle over a cross bar during its installation on or removal from the skid. Furthermore, there is a need for an end cap for a skid wherein a cross bar located at the end of the skid does not have to be removed to roll a vehicle off of the skid.

SUMMARY OF THE INVENTION

The end cap of the present invention solves the problems associated with conventional skids by providing an end cap rigidly secured to an end of a skid that has a means for rolling a vehicle through the end cap. Specifically, the end cap has at least one channel extending through the end cap wherein each channel of the end cap is aligned with one channel in the top of the platform of the skid. The principal advantage of the present invention is that a user can easily and quickly roll a vehicle on and off a skid having an end cap of the present invention because the wheel(s) of a vehicle roll through one or more channels in the end cap.

The end cap also comprises a means for attaching the end cap to the top of a platform of a skid. The end cap can be designed and manufactured in either multiple segments or as a single component. In addition, the end cap may optionally have a vertical extension extending down from one side of the end cap and attaching to the bottom of the platform such that the vertical extension covers the end of the platform and adds stability to the skid.

DESCRIPTION OF FIGURES

The present invention is described below in sufficient detail such that one of ordinary skill in the relevant art(s) can design and build a visual safety signal electrical cable of the present invention with all of the features described herein.

DETAILED DESCRIPTION

Figure 1:
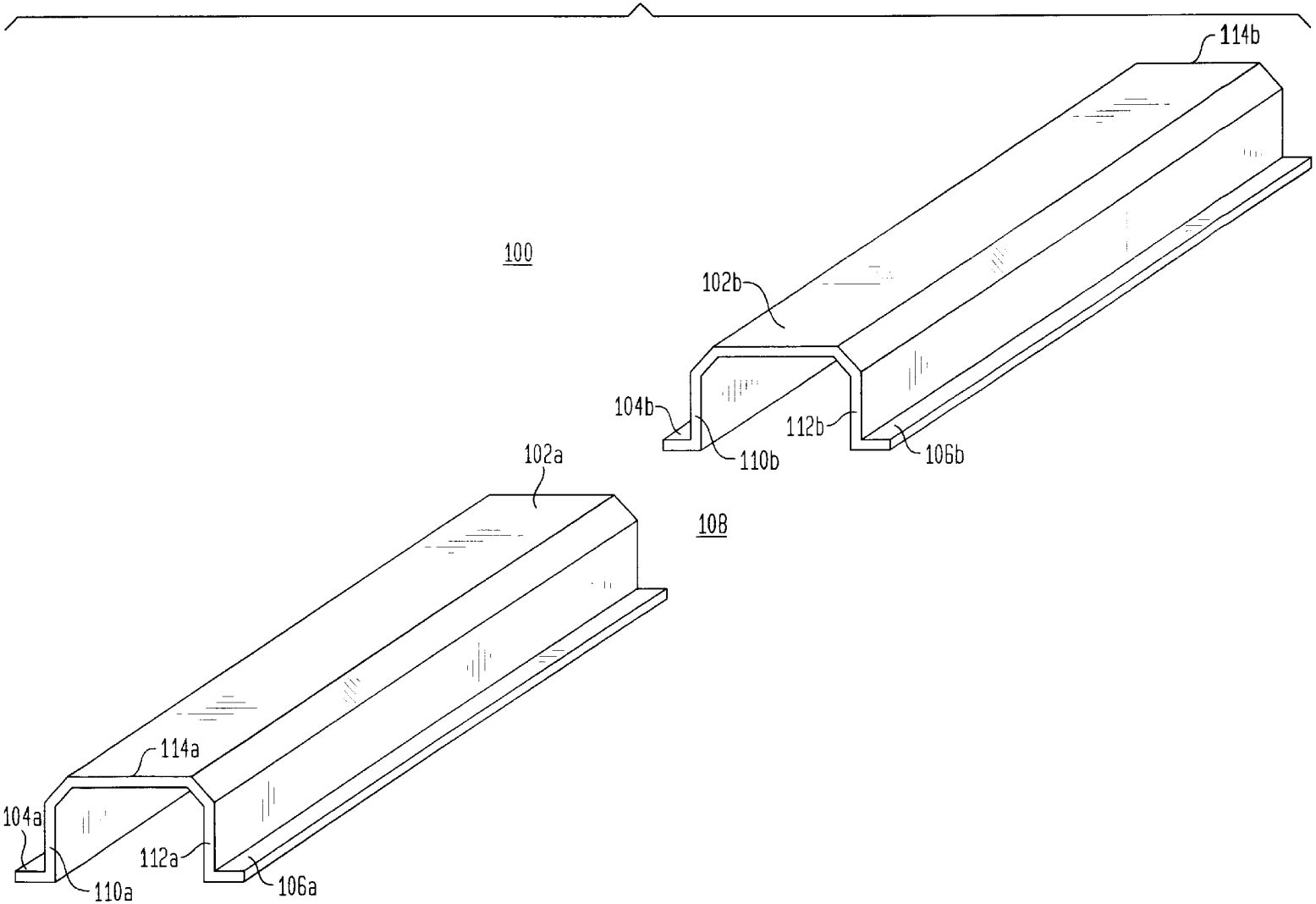
FIG. 1 is a perspective diagram of an end cap of the present invention.
Figure 2:
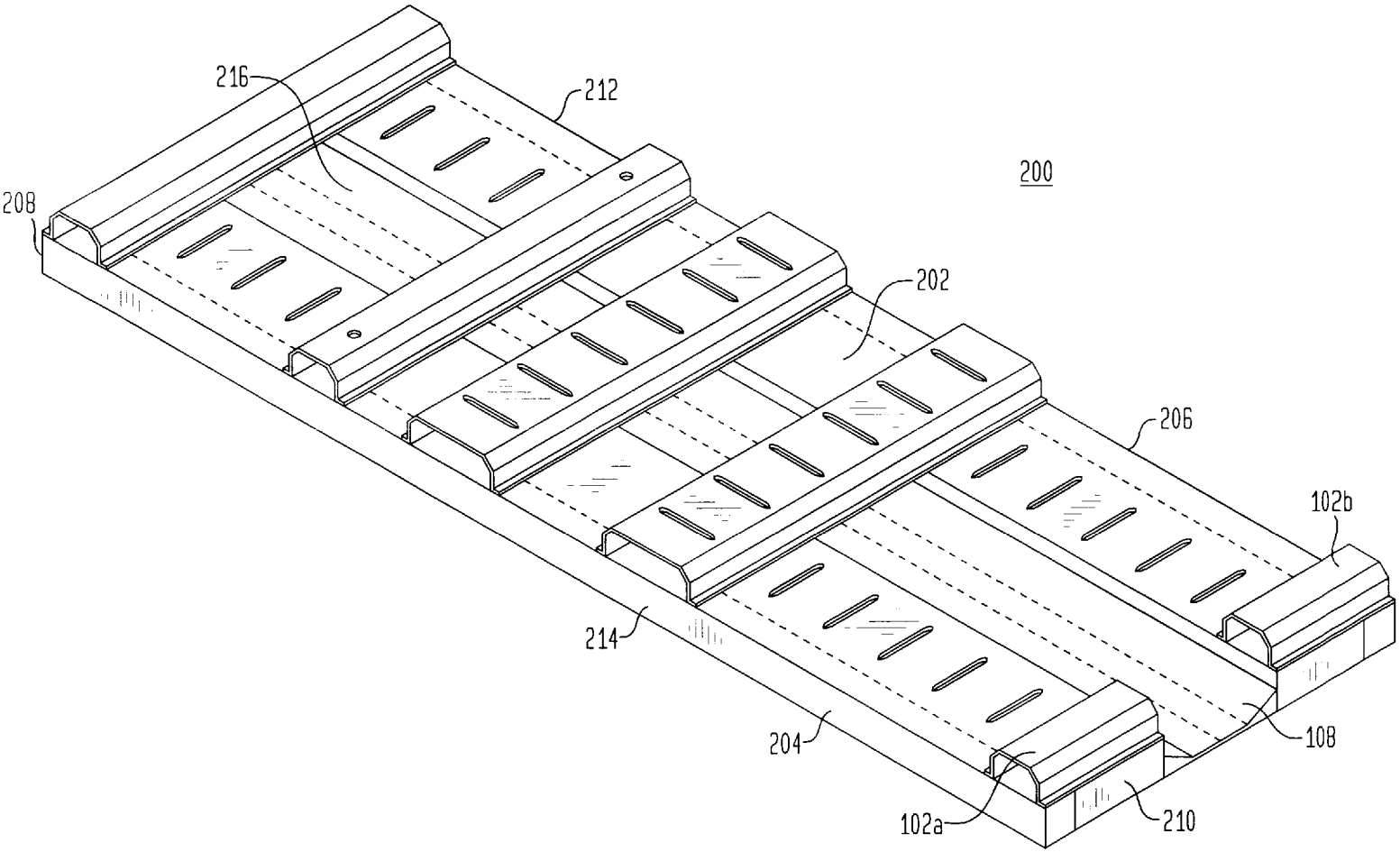
FIG. 2 is a planar back view of the end cap on a skid.
Figure 3:
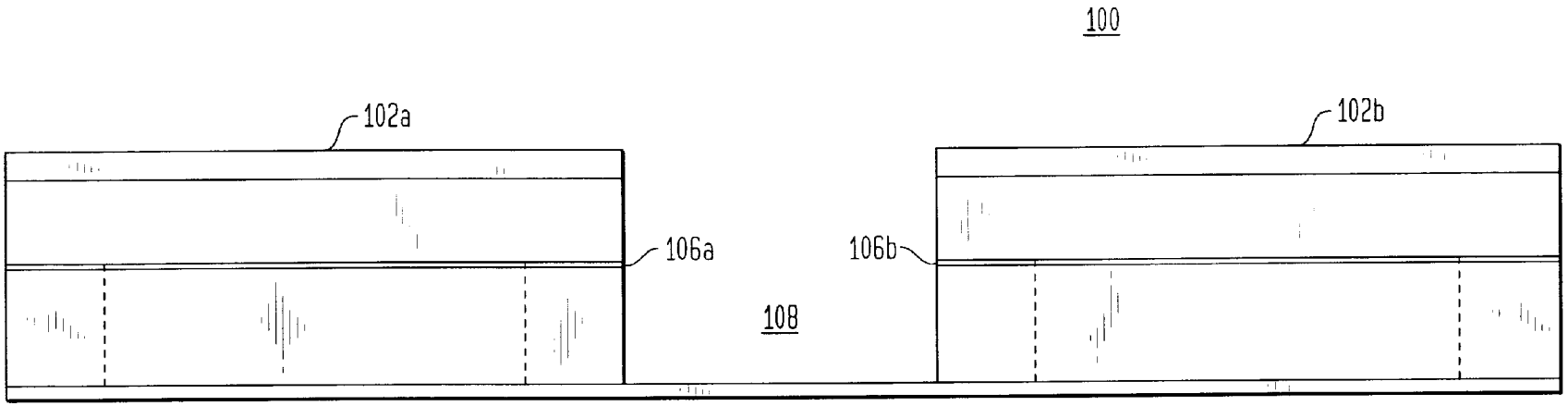
FIG. 3 is a perspective diagram of the end cap on a skid.

An end cap 100 of the present invention, and as used on a conventional skid 200, is described in FIGS. 1–3. The skid 200 is described in terms of storing and transporting a two wheeled vehicle, e.g., a motorcycle, but this is for convenience purpose only. It would be readily apparent to one of ordinary skill in the relevant art to design, manufacture, and use a skid 200 and an end cap 100 of the present invention with a vehicle having a different number of wheels. For example, when storing and transporting a four wheeled vehicle, the skid 200 has two parallel channels and the end cap 100 has two channels aligned herewith. In addition, the skid and end cap 100 of the present invention are preferably made of metal, but can be made of any comparable material, e.g., wood or a composite material.

The skid 200 has a platform 212 being generally rectangular in shape including a top 202, a bottom 214, a first side 204, a second side 206, a first end 208, a second end 210, and a longitudinally centered channel 216 in the top 202 and extending the length of the skid 200. In addition, the skid 200 has an end cap 100 rigidly attached to the second end 210 of the platform 212 having at least one channel 108 extending through the end cap 100 wherein each channel 108 of the end cap 100 is aligned with one channel 216 in the top 202 of the platform 212 of the skid 200.

In the preferred embodiment, the end cap 100 comprises multiple segments, such as a first end cap portion 102*a* and a second end cap portion 102*b*, both of which are rigidly secured to the top 202 of the platform 212 of a skid 200. Specifically, the first end cap portion 102*a* is attached to the top 202 of the platform 212 such that the outside edge 114*a* of the first end cap portion 102*a* is adjacent to, or flush with, the first side 204 of the platform 212, and the second end cap portion 102*b* is attached to the top 202 at the platform 212 such that the outside edge 114*b* of the second end cap portion 102*b* is adjacent to, or flush with, the second side 206 of the platform 212. The first end cap portion 102*a* is positioned a predefined distance from the second end cap portion 102*b*, thereby creating a channel 108 extending between the first end cap portion 102*a* and the second end cap portion 102*b* such that the channel 108 is aligned with the channel 216 in the top 202 of the platform 212 of the skid 200.

Also in the preferred embodiment, the first end cap portion 102*a* and the second end cap portion 102*b* are generally U-shaped and open downwards and have a means for attaching to the top 202 of the platform 212 of the skid 200. The preferred means for attaching is a first flange 104*a,* 104*b* attached to the first side 110*a,b* of the first end cap portion 102*a* and the second end cap portion 102*b,* and a second flange 106*a, b* attached to the second side 112*a,b* of the first end cap portion 102*a* and the second end cap portion 102*b*. Therefore, the first end cap portion 102*a* and the second end cap portion 102*b* are attached to the top 202 of the platform 212 of a skid 200 via the first flange 104*a,* 104*b* and the second flange 106*a,* 106*b* by any conventional means, e.g., welding, nuts and blots, clips, fasteners, or, if appropriate, an adhesive.

In this embodiment, the cross sectional shape of the channel 108 between the first end cap portion 102*a* and the second end cap portion 102*b* is generally rectangular, but this is for convenience purpose only. It would be readily apparent to one of ordinary skill in the art to use a first end cap portion 102*a* and a second end cap portion 102*b* having a different shape, thereby resulting in a channel 108 having a different shape. For example, the channel 108 may have two or more angled edges.

Figure 4:
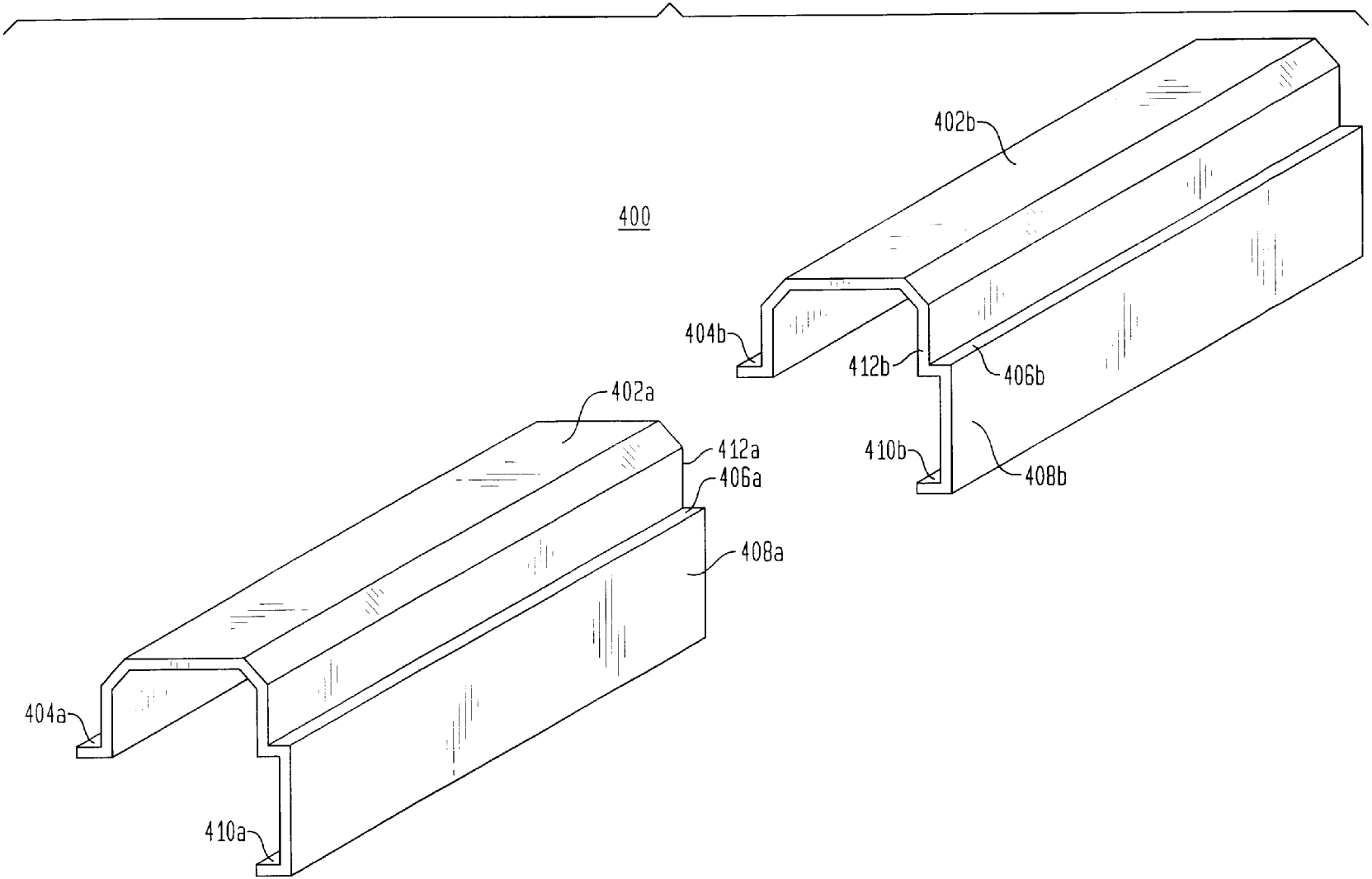
FIG. 4 is a perspective diagram of an alternative end cap.
Figure 5:
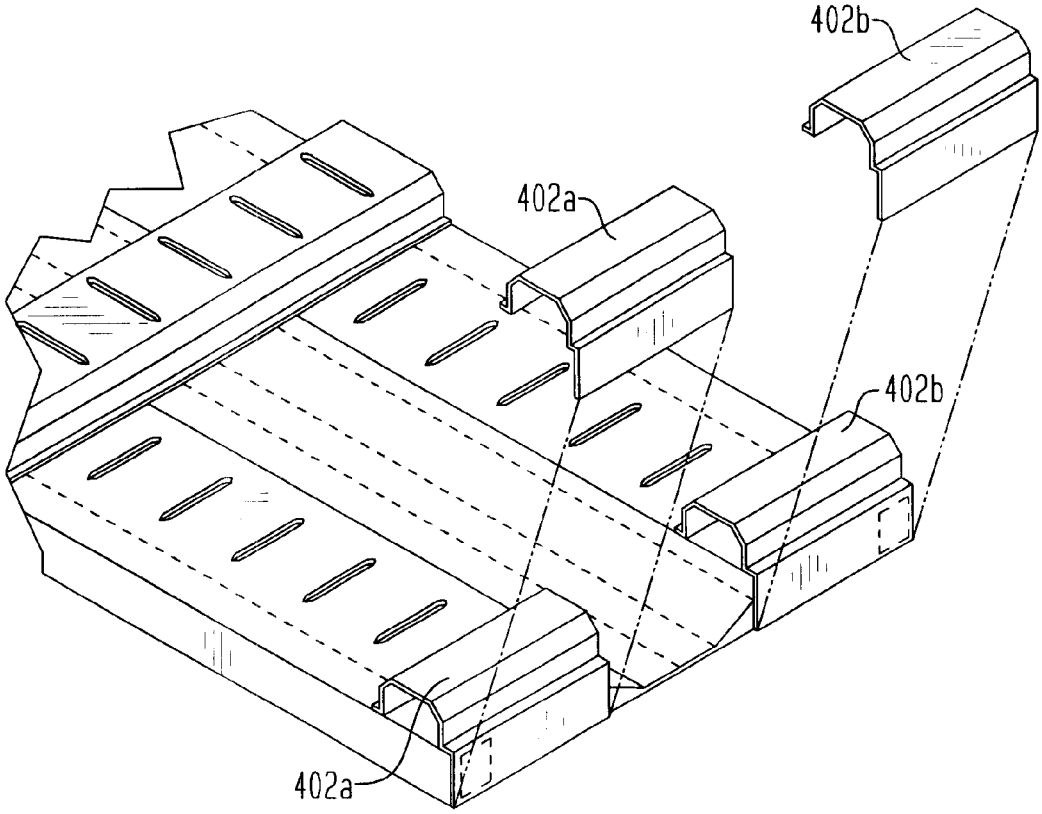
FIG. 5 is a perspective diagram of the alternative end cap on a skid.

In an alternative embodiment shown in FIGS. 4–5, the end cap 400 of the present invention includes a means for covering the second end 210 of the platform 212. FIG. 4 shows an end cap 400 preferably having a first end cap portion 402*a* with a first flange 404*a* and a second flange 406*a,* and a second end cap portion 402*b* with a first flange 404*b* and a second flange 406*b*. The preferred means for covering the second end 210 of the platform 212 are vertical extensions 408*a,b* rigidly attached to a second side 412*a* of the first end cap portion 402*a* and a second side 412*b* of the second end cap portion 402*b*. The vertical extensions 408*a,b* are attached such that when the first end cap portion 402*a* is attached to the second end 210 of the platform 212, the first vertical extension 408*a* of the first end cap portion 402*a* extends over and covers a first portion of the second end 210 of the platform 212, and when a second vertical extension 408*b* is attached to the second side 412*b* of the second end cap portion 408*b* and the second end cap portion 402*b* is attached to the second end 210 of the platform 212, the second vertical extension 408*b* of the second end cap portion 402*b* extends over and covers a second portion of the second end 210 of the platform 212.

The vertical extensions 408*a,b* also have a means for attaching to the bottom 214 of the skid 200 in order to secure the end cap 400 to the skid 200. The preferred means is are flanges 410*a,b* located at the bottom of the vertical extensions 408*a,b* that are secured to the bottom 214 of the skid 200 by any conventional means, e.g., welding, nuts and bolts, clips, fasteners, and, if appropriate, an adhesive.

Figure 6:
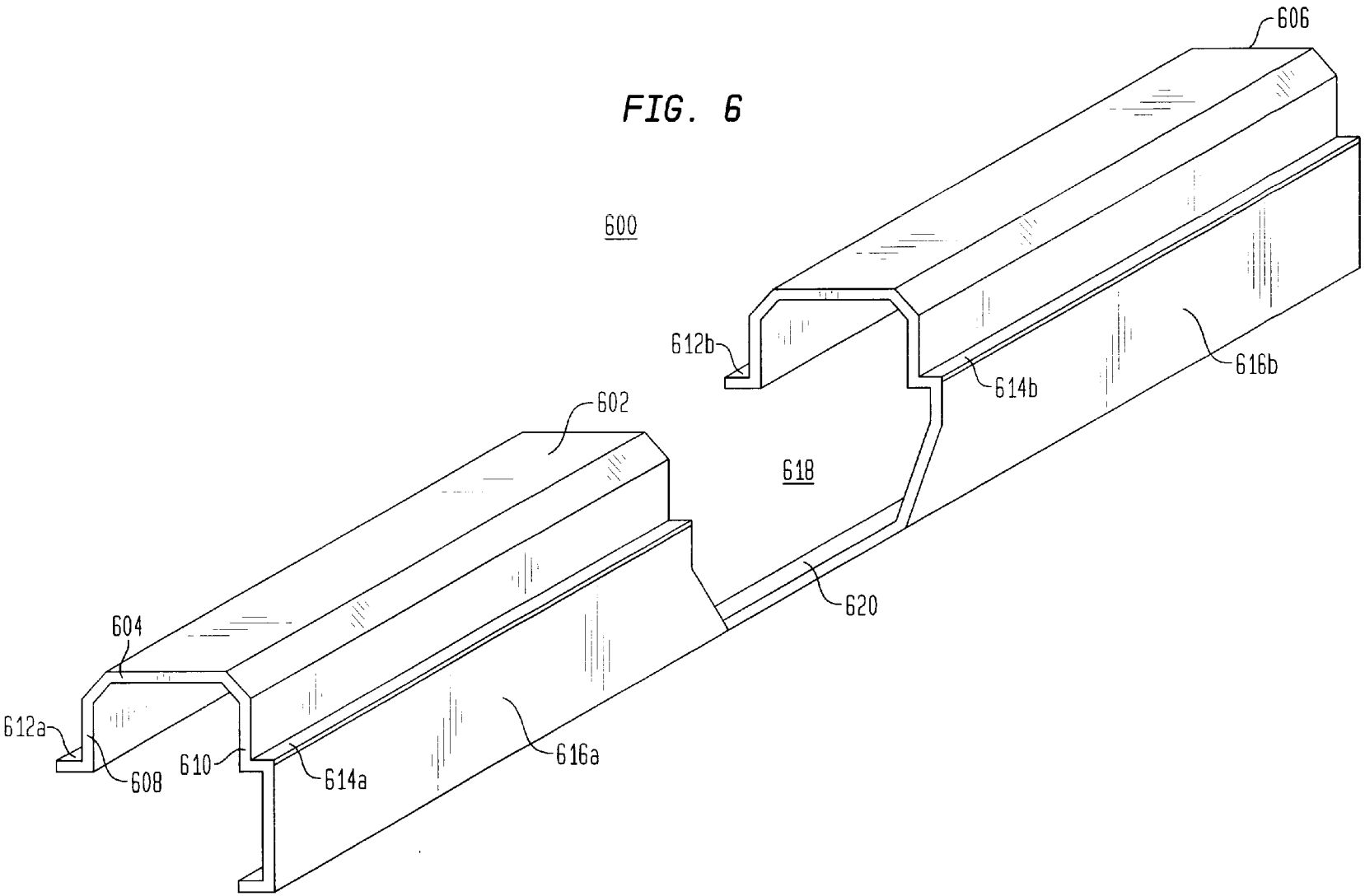
FIG. 6 is a perspective diagram of a one piece end cap.
Figure 7:
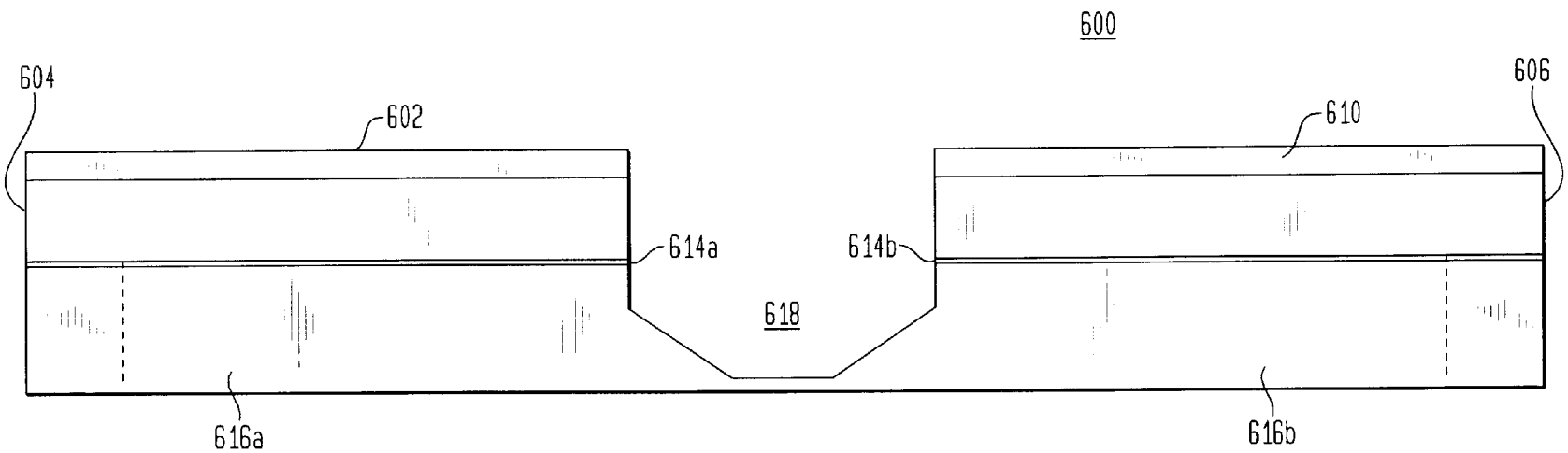
FIG. 7 is a planar back view of the one piece end cap.

In a second embodiment of the present invention, as shown in FIGS. 6–7, the end cap 600 is an elongated bar 602 having a first side 608 with a first flange 612*a,* 612*b,* a second side 610 with a second flange 614*a,* 614*b,* a first outside edge 604 and a second outside edge 606, one or more channels 618 extending through the elongated bar 602 from the first side 608 to the second side 610 wherein each channel 618 of the end cap 600 is aligned with one channel 216 in the top 202 of the platform 212. The end cap 600 also includes a means for attaching the elongated bar 602 to the second end 210 of platform 212 such that the elongated bar 602 extends from the first side 204 of the platform 212 to the second side 206 of the platform 212. The first outside edge 604 is flush with the first side 204 of the skid 200 and the second outside edge 606 is flush with the second side 206 of the skid 200.

As described above in the other embodiments, the preferred elongated bar 602 is generally U-shaped and opens downwards. In addition, the end cap 600 has a vertical extension 616*a,b* rigidly attached to the second side 610 of the elongated bar 602 wherein the vertical extension 616*a,b* extends over and covers a portion of the second end 210 of the platform 212. The vertical extension 616*a,b* also has a means for attaching to the bottom 214 of the skid 200. The channel 618 of the end cap 600 may have any shape, such as a generally rectangular cross section or as having two or more angled edges as shown in FIGS. 6 and 7.

The end cap 600 also includes a means for attaching to the top 202 of the platform 212 of a skid 200, which is similar to the means described above. That is, the elongated bar 602 has two or more flanges, such as a first flange 612*a,b* located on the first side 608 of the elongated bar 602 and a second flange 614*a,b* located on the second side 610 of the elongated bar 602. The first flange 612*a,b* and the second flange 614*a,b* are attached to the top 202 of the platform 212 by any conventional means, e.g., welding, nuts and bolts, clips, fasteners, and, if appropriate, an adhesive.

In operation, a user installs a vehicle, e.g., a motorcycle, on a skid 200 having an end cap 100 of the present invention by first aligning a wheel of the vehicle with the channel 108 of the end cap 100 of the skid 200. Once aligned, the user rolls the vehicle through the channel 108 of the end cap 100 such that the wheel of the vehicle is positioned in the channel 216 of the skid 200. Lastly, the user secures the vehicle to the skid 200 by conventional means.

To remove the vehicle from the skid 200, the user simply un-secures the vehicle from the skid 200 and rolls the vehicle along the channel 216 of the skid 200 and through the channel 108 of the end cap 100 until the vehicle is completely off of the skid 200.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined. Thus, the breadth and scope of the present invention should not be limited by any of the above-described exemplary embodiments.

What is claimed is:

1. A skid for storing and transporting a vehicle having at least one wheel, comprising:

a platform having a top, a bottom, a first side, a second side, a first end, a second end, and one or more channels extending longitudinally in said top of said platform; and an end cap rigidly secured to said first end of said platform having at least one channel extending through said end cap wherein each said channel of said end cap is aligned with one said channel in said top of said platform;

wherein said end cap is a single component comprising an elongated bar having a first end, a second end, a first side and a second side, wherein said elongated bar extends from said first side of said platform to said second side of said platform.

2. The skid according to claim 1, wherein each channel of said at least one channel extending through said end cap has a generally rectangular cross section.

3. The skid according to claim 1, wherein each channel of said at least one channel extending through said end cap has a cross section having two or more angled edges.

4. The skid according to claim 1, wherein said end cap further comprises a means for covering said first end of said skid.

5. The skid according to claim 4, wherein said means for covering comprises one or more vertical extensions rigidly attached to a side of said end cap wherein said one or more vertical extensions extend over and cover a portion of said first end of said skid.

6. The skid according to claim 5, wherein said vertical extensions comprise a means for attaching to said top of said skid.

7. The skid according to claim 6, wherein said means for attaching to said top of said skid is a flange and a means for attaching said flange to said top of said skid.

8. The skid according to claim 7, wherein said means for attaching said flange is selected from the group of welding, nuts and bolts, clips, fasteners, and adhesive.

9. The skid according to claim 1, wherein said platform and said end cap are made of metal.

10. A skid for storing and transporting a vehicle having at least one wheel, comprising:

a platform having a top a bottom, a first side, a second side, a first end, a second end, and one or more channels extending longitudinally in said top of said platform; and an end cap rigidly secured to said first end of said platform having at least one channel extending through said end cap wherein each said channel of said end cap is aligned with one said channel in said top of said platform, wherein said end cap is generally U-shaped and open downwards and further comprising a means for attaching to said top of said platform.

11. The skid according to claim 10, wherein said means for attaching comprises said end cap having one or more flanges and a second means for attaching to said top of said platform.

12. The skid according to claim 11, wherein said second means for attaching is selected from the group of welding, nuts and bolts, clips, fasteners, and an adhesive.

* * * * *